US009145633B2

(12) United States Patent
Lv et al.

(10) Patent No.: US 9,145,633 B2
(45) Date of Patent: Sep. 29, 2015

(54) SMALL SIZE PULSATOR-TYPE AUTOMATIC WASHING MACHINE

(75) Inventors: Peishi Lv, Qingdao (CN); Sheng Xu, Qingdao (CN); Jie Liu, Qingdao (CN); Xiaojie Pi, Qingdao (CN); Yuling Chen, Qingdao (CN)

(73) Assignees: HAIER GROUP CORPORATION, Qingdao, Shandong (CN); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 114 days.

(21) Appl. No.: 14/002,298

(22) PCT Filed: Aug. 3, 2011

(86) PCT No.: PCT/CN2011/077968

§ 371 (c)(1),
(2), (4) Date: Aug. 29, 2013

(87) PCT Pub. No.: WO2012/119370

PCT Pub. Date: Sep. 13, 2012

(65) Prior Publication Data

US 2013/0333424 A1 Dec. 19, 2013

(30) Foreign Application Priority Data

| | | |
|---|---|---|
| Mar. 4, 2011 | (CN) | 2011 1 0052328 |
| Mar. 4, 2011 | (CN) | 2011 1 0052336 |
| Mar. 21, 2011 | (CN) | 2011 1 0067214 |

(51) Int. Cl.

| | |
|---|---|
| ***D06F 13/02*** | (2006.01) |
| ***D06F 23/04*** | (2006.01) |
| ***D06F 37/20*** | (2006.01) |
| ***D06F 37/40*** | (2006.01) |
| *D06F 37/24* | (2006.01) |
| *D06F 39/12* | (2006.01) |

(52) U.S. Cl.
CPC ..... *D06F 13/02* (2013.01); *D06F 23/04* (2013.01); *D06F 37/206* (2013.01); *D06F 37/40* (2013.01); *D06F 37/24* (2013.01); *D06F 39/12* (2013.01)

(58) Field of Classification Search
None
See application file for complete search history.

(56) References Cited

U.S. PATENT DOCUMENTS 4,646,545 A * 3/1987 Fanson et al. ..... 68/23.2

(Continued)

FOREIGN PATENT DOCUMENTS

| | | |
|---|---|---|
| CN | 1093129 A | 10/1994 |
| CN | 2337169 Y | 9/1999 |
| CN | 1375593 A | 10/2002 |

(Continued)

OTHER PUBLICATIONS

International Search Report (PCT/ISA/210) mailed on Dec. 1, 2011, by the Chinese Patent Office as the International Searching Authority for International Application No. PCT/CN2011/077968.

*Primary Examiner* — Michael Barr
*Assistant Examiner* — Cristi Tate-Sims
(74) *Attorney, Agent, or Firm* — Buchanan Ingersoll & Rooney PC

(57) ABSTRACT

A small size pulsator-type automatic washing machine comprises a housing, a control panel seat mounted on the top of the housing, a pedestal mounted at the bottom of the housing, an outer tub and an inner tub mounted inside the housing. A direct driving motor and a bearing block are mounted at the bottom of the outer tub. The motor is mounted on the outer tub by fixing elements, and a motor shaft is coupled with a pulsator shaft inside the bearing block. A fastener strap fixes the motor and the bearing block together onto the outer tub of the washing machine, thus reducing occupied space of the washing machine while improving a variety of installation mechanism of conventional washing machine. An insulation unit is disposed in the joint between the motor shaft and the tub shaft, such that the two parts cannot be in direct contact.

19 Claims, 5 Drawing Sheets

(56) References Cited

U.S. PATENT DOCUMENTS

| | | | | |
|---|---|---|---|---|
| 5,377,508 | A * | 1/1995 | Hair et al. | 68/4 |
| 5,381,677 | A | 1/1995 | Park et al. | |
| 5,651,277 | A * | 7/1997 | Richardson | 68/23.7 |
| 2005/0011233 | A1 * | 1/2005 | Vaidhyanathan et al. | 68/23.7 |

FOREIGN PATENT DOCUMENTS

| | | | |
|---|---|---|---|
| CN | 201151827 | Y | 11/2008 |
| CN | 201217747 | Y | 4/2009 |
| JP | 10-043468 | A | 2/1998 |
| KR | 2003-0024962 | A | 3/2003 |

* cited by examiner

SMALL SIZE PULSATOR-TYPE AUTOMATIC WASHING MACHINE

FIELD OF THE INVENTION

The invention relates to the technical field of the washing machine, particularly, a small size pulsator-type automatic washing machine with full functions.

BACKGROUND OF THE INVENTION

The washing capacity of the ordinary household automatic washing machine is generally 3~6 kg, when washing small clothes it is not convenient, not economical and not worthwhile. Now there are some small washing machines that can wash socks, baby clothes and other small clothes, but these small washing machines can not be directly designed on the base of the structure of the ordinary fully automatic washing machine. Therefore, it only achieves the washing function of common automatic washing machine, the washing and dewatering function can not be achieved at the same time, moreover, it can not reduce the volume of the washing machine, if washing and dewatering simultaneously, so the small size of automatic washing machine is lacked in the present society.

A small size washing machine has strict requirements on the volume and capacity. Now some pulsator-type washing machine use the direct driving motor, the direct driving motor is mounted directly in the washing machine at the bottom of the outer tub, the motor shaft drives the pulsator shaft to work, though the volume of the washing machine is small in this way, the space at the bottom of the outer tub is very narrow, there is no enough space for the drain pump, the water level sensor and other components. In addition, in the prior art, the motor is fixedly connected with the outer tub by the bolts and the screws, but in the small washing machine, because of the narrow space, it is easy to appear the problem such as the alignment of the screw and so on, and it is inconvenient when installing.

The patent with the public number CN1375593A discloses a small size washing machine in which the motor and the washing tub is separate, the motor is arranged in a cavity, the motor shaft drive the washing tub by the gearing, the washing tub can be remove freely, but the washing machine can realize the function of washing and rinsing only, can not realize the function of dewatering, because of the only one washing tub.

The patent with the public number CN201151827Y discloses a new washing machine with direct driving clutch, the washing machine uses the buoyancy work mode, the motor is the direct driving motor, the motor shaft is connected with the pulsator shaft directly, the motor is arranged at the bottom of the outer tub and installed together with the outer tub through the intermediate device, but the fixation between the motor and the intermediate device need the bolt or screw, so it increases the difficulty to fix.

The patent with the public number CN201217747Y discloses a new direct drive device of washing machine, the motor is installed in the washing machine by a reducer, the output shaft of the reducer is the pulsator shaft, the motor shaft connected with the reducer drives the pulsator shaft indirectly, in this scheme, the reducer is arranged between the motor and the outer tub, so the connection structure is complex, it requires stable transmission between components, and it is easy to result in the high failure rate.

In the practical work, it will result in the electrical current leakage when the bad assembly of the motor, the component wear, the aging lines, the high ambient humidity and other factors, As the material of the motor shaft and the pulsator shaft is metal, the leakage of electrical current will transmit to the washing machine tub, will cause the washing machine to be electrified. Thus causes an electric shock hazard to the user.

In the prior art, there is a washing machine with floating structure, in such washing machine, the floating and sinking of the inner is controlled by the buoyancy of water, so the washing capacity is small, the structure is as follows: there is a buoyancy chamber at the bottom of the inner tub of the washing machine, the middle of the bottom of the inner tub joint the drive shaft of pulsator by the sealed bearing, the clutch device of washing machine is consisted of the concave gear installed at the periphery of the sealed bearing and the convex gear installed at the pulsator driving shaft between the outer tub and the inner tub, the concave gear and the convex gear are meshing when the washing machine is in the dehydration or not working, when the washing machine is filled with water, the buoyancy chamber of the inner tub forms a sealing cavity, which drive the separation the concave gear from the convex gear, so that the inner tub is driven to rise along the pulsator shaft, then it start washing.

The patent with the public number CN98221706.4 discloses a clutch device of washing machine, the clutch device is consisted of the concave gear and the convex gear, The washing tub can be driven to move along the pulsator shaft by a gas chamber in the buoyancy of water, when washing, the washing tub floats upward by the gas chamber in the presence of water, so that the concave gear at the bottom of the inner tub is separated from the convex gear on the main shaft, the motor drives the pulsator only for washing, when dewatering, the concave gear at the washing tub and the convex gear at the main shaft are meshing and rotating with the pulsator together. But all kinds of impurities contained in the clothes will be adhered to the connection of pulsator driving shaft; it will affect the floating and sinking of the inner tub along the pulsator driving shaft.

SUMMARY OF THE INVENTION

An object of the present invention is to overcome the disadvantages of the small washing machine in the prior art, such as the complexity of the structure of the gearing and the difficulty in reducing the volume, to provide a small size pulsator-type automatic washing machine. The washing machine with small volume and full functions can proceed to fully automatically wash small items.

Another object of the present invention is to overcome the disadvantages of the small washing machine in the prior art, such as the complexity of the structure of the clutch device and the difficulty in reducing the volume, to provide a small size pulsator-type automatic washing machine. The washing machine uses the buoyancy clutch, of which the structure is simple, safe and reliable.

Another object of the present invention is to overcome the disadvantages of the small washing machine in the prior art, such as the complexity and difficulty of the installation of the motor, to provide a small size pulsator-type automatic washing machine The washing machine of which the motor is easily installed saves space and reduces the overall volume.

Another object of the present invention is to provide a automatic washing machine with the washing capacity of less than 1 kg, which includes at least the functions of washing, rinsing and dewatering.

In order to attain the above purpose, the following scheme is adopted in the invention:

A small size pulsator-type automatic washing machine, comprising a housing, a control panel seat, a pedestal, an outer tub, an inner tub and a motor, wherein the control panel seat is mounted on the top of the housing, and the pedestal is mounted at the bottom of the housing, and the outer tub and the inner tub are mounted inside the housing, the motor is a direct driving motor, and the motor and a bearing block are mounted at the bottom of the outer tub, and the motor is mounted on the outer tub by fixing device at least, a motor shaft is coupled with a pulsator shaft inside the bearing block, and a buoyancy clutch device is provided on the outer tub and the inner tub.

In order to rapidly install and mutually position between the motor and the bearing block, a positioning structure matching with the motor is installed on the bearing block to prevent the radial movement of the motor, and at least the positioning structure holds the motor partially. Preferably, the positioning structure is at least three positioning plates and/or at least one positioning ring.

To strengthen the positioning effect between the motor and the bearing block and improve the stability of the positioning structure of the bearing block, the positioning plate and/or the positioning ring is mounted at an installing surface of the bearing block mating with the motor. The positioning plate is perpendicular to the installing surface and arranged around a shaft hole of the bearing block as the virtual center radially and symmetrically. The contact surface of the positioning plate contacting with the motor is partially provided with a positioning table protruding from the contact surface. The vertical distance between the inner edge of the positioning table and the axis of the shaft hole is equal to or slightly larger than the diameter of the motor. The positioning ring is a circular tube or an arc segment concentric with the shaft hole of the bearing block, of which diameter is larger than the one of the shaft hole. The contact surface of the motor contacting with the bearing block is provided with a positioning groove matching with the positioning ring.

To strengthen the positioning effect of the positioning ring, the positioning ring intersects the positioning plate, and the positioning ring is higher than the positioning plate at the intersection.

To strengthen the sealing between the bearing block and the outer tub and be convenient for the installation, a fixed surface of the bearing block contacting with the bottom of the outer tub is provided with a protective sleeve being upwards convex along the circumference of the shaft hole of the bearing block, through which the motor shaft and the pulsator shaft are coaxially connected.

To improve the sealing effect of the bearing block and the rotating effect of the pulsator shaft, a skeleton oil seal is arranged in the upper end of the protective sleeve, and a shaft sleeve is provided on the lower end of the protective sleeve and inside the shaft hole of the bearing block. The pulsator shaft is provided with a shield ring locating between the skeleton oil seal and the shaft sleeve.

To improve the waterproof effect of the protective sleeve, the height of the protective sleeve is larger than the thickness of the bottom of the outer tub.

To reduce the leakage conduction between the motor shaft and the pulsator shaft, a insulation unit is provided between the motor shaft and the pulsator shaft, so as to isolate the direct contact between the motor shaft and the pulsator shaft. The structure of the insulation unit adapts to the structure of the contact surface between the motor shaft and the pulsator shaft.

To avoid the effect of the water leakage on the motor, the insulation unit comprises a sheath of which the diameter is larger than the one of the shaft hole of the bearing block. The sheath is a cylindrical plane and perpendicular to the motor shaft.

To reduce the stationary component between the motor and the outer tub, the fixing device is a fixing belt with the shape of "U". The fixing belt comprises two sides and a pressing edge for connecting the two sides. The two sides are respectively fixed on the bottom of the outer tub through the ends, and the fixing belt presses and fixes the motor and the bearing block on the bottom of the outer tub.

To improve the fixing effect of the fixing belt and the motor, there is a bearing bulge on the other side of the motor being relative to the motor shaft, and a fixing hole is arranged in the middle of the pressing edge. The fixing hole is corresponding to the bearing bulge. A shock pad is provided between the fixing hole and the bearing bulge.

To reduce the clutch components between the inner tub and the outer tub, and decrease the volume of the washing machine, the buoyancy clutch device on the outer tub and the inner tub comprises a buoyancy chamber being arranged at the bottom of the inner tub, a concave gear around the shaft hole at the bottom of the inner tub, and a convex gear on the pulsator shaft between the outer tub and the inner tub.

To avoid the contact between the pulsator shaft and the washing water, and reduce the friction generated by the inner cylinder lifting and falling, an inner buoyancy chamber is provided round the shaft hole of the pulsator shaft in the buoyancy chamber. The inner buoyancy chamber is circumferentially constituted by an insulation rib integrating with the bottom of the inner tub. After the washing machine is filled with water, the inner buoyancy chamber forms a sealing cavity.

To improve the exchange of the washing water between the inner tub and the outer tub, the periphery of the insulation rib is provided with an insulation ring integrating with the bottom of the inner tub. Water holes are arranged on the inner tub between the insulation rib and the insulation ring preferably, the top of the insulation ring protrudes the top of the buoyancy chamber, the height of the protective sleeve on the bearing block is larger than the thickness of the bottom of the outer tub, and the protective sleeve extends partially into the inner buoyancy chamber.

To avoid to affect the washing by the rotation of the inner tub with the pulsator shaft, a balance ring is arranged on the top of the inner tub, and a cover of the outer tub is arranged on the top of the outer tub, and a blocking structure is arranged between the top of the inner tub and the top of the outer tub. The block structure includes a bulge on the surface of the balance ring and on the surface of the cover of the outer tub facing to the balance ring. After the inner tub floats up, the bulge on the balance ring contacts with the one on the cover of the outer tub each other to stop the rotation of the inner tub.

To improve the transmission efficiency of the motor shaft and the pulsator shaft, the top of the motor shaft connects with the pulsator shaft flexibly. Preferably, the motor shaft connects with the pulsator shaft by gears, or the top of the motor shaft is the polygonal prism, and an inner groove is arranged on the contact end of the pulsator shaft for matching with the motor shaft.

To reduce the leakage conduction between the motor shaft and the pulsator shaft, the insulation unit with the shape of the bottle cap is arranged between the motor shaft and the pulsator shaft. The center of the bottle cap is provided with a bulge that adapts to the contact surface between the motor shaft and the pulsator shaft.

After the above structure is adopted, the washing machine of the invention can wash the clothes less than 1 kg under the control of the full automatic washing procedures.

The present invention has the following beneficial effects:

The invention improves the transmission structure of the existing washing machine, uses the direct driving motor, the motor is installed on the bottom of the outer tub through the bearing block, The motor of the automatic washing machine, the reducer and other components are removed, thus the space at the bottom of the washing machine is reduced, and the volume of the washing machine is reduced. The motor shaft of the motor cooperated with the pulsator shaft drives directly in the bearing block, and the motor shaft and the pulsator shaft are connected with each other by the gear structure or by the polygonal prism structure can increase the friction between the two components, improve the power transmission efficiency, reduce the intermediate links, and the driving structure is more simple and convenient, the bearing block has the role of protecting and stabilizing the joint. the positioning plate and/or the positioning ring arranged in the bearing block can ensure that the motor is installed in place quickly and prevent the motor to move in the radial direction, improve the stability of the motor. The fixing between the positioning groove of the motor and the positioning ring improves the fixed effect. The protective sleeve arranged in the bearing block provides the protection space and prevents the washing water entering into the bearing block, that the bearing and the skeleton oil seal arranged in the protective sleeve can reduce the friction between the motor shaft and the pulsator shaft. The shield ring on the pulsator shaft can improve the axial stability of the pulsator shaft and share the weight of the pulsator. The insulation unit arranged between the motor shaft and the pulsator shaft can prevent the water infiltration from the outer tub to the motor, and prevent the electric leakage transfer to the outer tub, the structure of the insulation unit adapts to the structure of the contact surface between the motor shaft and the pulsator shaft, and the insulation unit can avoid the wear of the contact end between the motor shaft and the pulsator shaft.

In the invention, that the motor and/or the bearing block fixed on the bottom of the outer tub can reduce the fixed structure of the motor and the bearing block, make the installation of the motor more convenient, and improve the installation efficiency. The fixing hole arranged in the pressing edge of the fixing belt not only avoids the oppression of the motor shaft, but also stabilize the motor by the use of cushion.

In the invention, the promotion and demotion of the inner tub controlled by the clutch structure of the buoyancy control can reduce the quantity of the mechanical device and reduce the failure rate. The bulges arranged on the balance ring on the inner tub and the outer tub cover contact each other to stop the rotation of the inner tub and improve the friction effect of the inner cylinder and the clothes after the inner tub floats up. The inner buoyancy chamber constituted by the insulation rib integrated the protective sleeve of the bearing block makes the location of the junction between the pulsator shaft and the protective sleeve above the water level, avoid the washing water influence the sealing effect from the junction into the protective sleeve and reduce the life of the skeleton oil seal, simultaneously, avoid the adhesion of impurities in the pulsator shaft between the protective sleeve and the bottom of the inner tub reduce the buoyancy effect of the inner cylinder. According to the machining needs, the insulation rib integrate with the inner tub or integrated with the concave gear, that the insulation rib integrate with the inner tub can reduce the measures of sealing, and the insulation rib integrate with the concave gear can make the installation more flexible. The water hole between the insulation ring and the insulation rib can avoid the seal cavity is affected by the buoyancy chamber.

In the invention, the reasonable arrangement of less structure reduces the volume of the washing machine, and the washing machine washing quantity is controlled within 1 kilograms, the washing machine realizes the full automatic washing.

DESCRIPTION OF DRAWING REFERENCES

Figure 1:
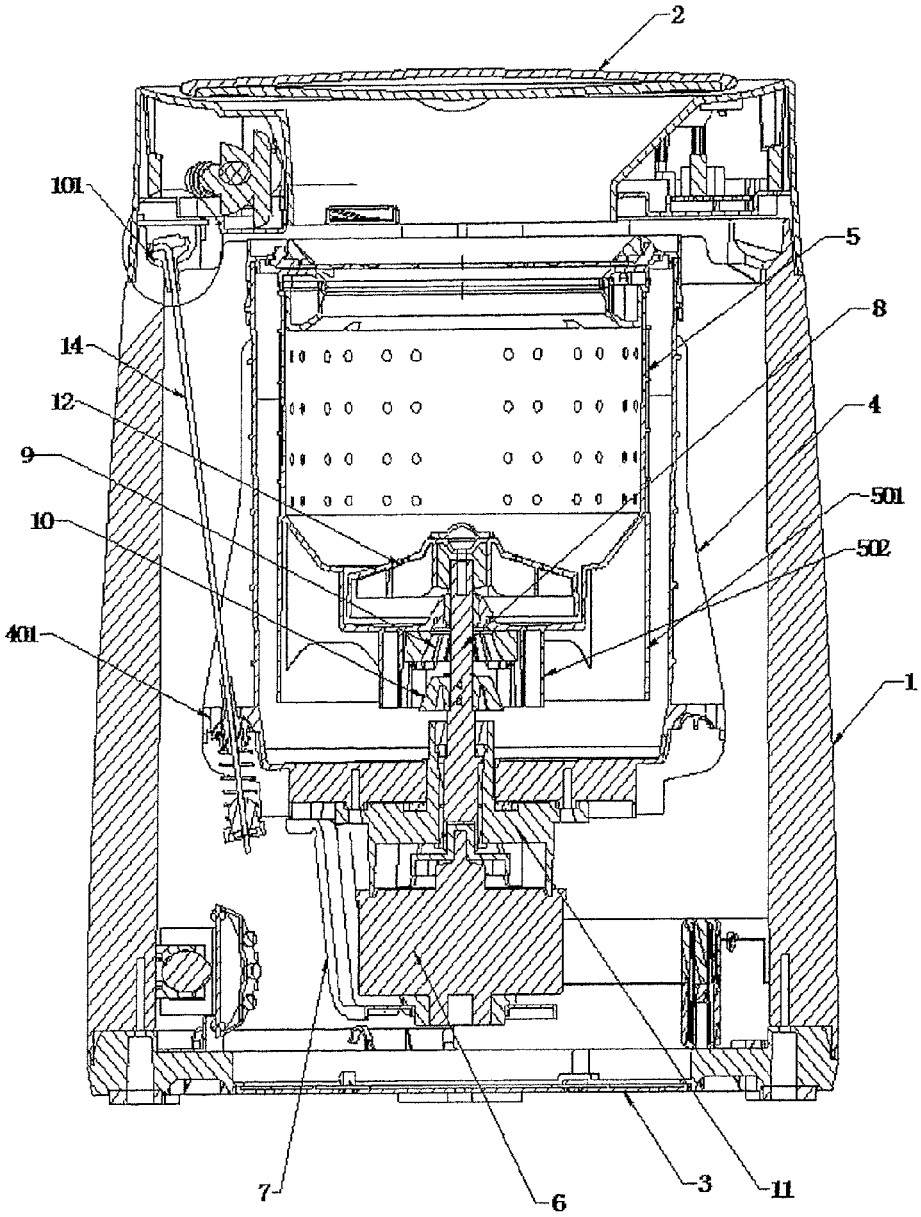
FIG. 1: the schematic illustration of the structure of the small size washing machine in the present invention

1—the housing, 101—the suspension seat, 2—the control panel seat, 3—the pedestal, 4—the outer tub, 401—the damping seat, 402—the cover of the outer tub, 5—the inner tub, 501—the buoyancy chamber, 502—the inner buoyancy chamber, 503—the insulation ring, 504—the water hole, 505—the insulation rib, 506—the balance ring, 507—the bulge, 6—the motor, 601—the motor shaft, 602—the positioning concave ring, 7—the fixing belt, 701—the side, 702—the pressing edge, 703—the fixing hole, 8—the pulsator shaft, 9—the concave gear, 10—the convex gear, 11—the bearing block, 1101—the fixed surface bearing block, 1102—the installing surface, 1103—the positioning plate, 1104—the positioning table, 1105—the positioning ring, 1106—the reinforce rib, 1107—the fixing hole, 1108—the protective sleeve, 1109—the shaft sleeve, 1110—the shaft hole, 1111—the skeleton oil seal, 1112—the shield ring, 12—the pulsator, 13—the insulation unit, 1301—the sheath, 14—the damping suspender, 1401—the suspender, 1402—the upper spherical seat, 1403—the lower spherical seat, 1404—the spring, 1405—the spring seat, 1406—the conical tube.

EMBODIMENT

The invention of the washing machine will now be described further with reference to a non-limiting specific embodiment as shown in the drawings.

Figure 2:
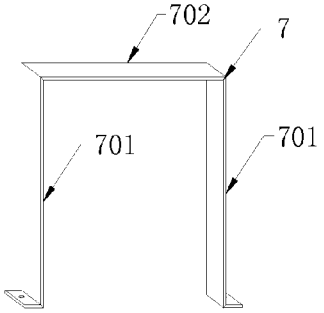
FIG. 2: the schematic illustration of the structure of the fixing belt in the present invention
Figure 3:
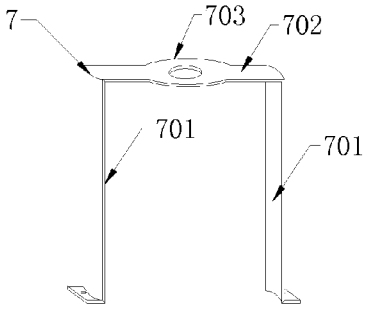
FIG. 3: another schematic illustration of the structure of the fixing belt in the present invention

As FIG. 1 shown, the technical scheme relates to a small size pulsator-type automatic washing machine (hereinafter referred to as the washing machine for short). The washing machine realizes the washing, rinsing and dewatering process automatically under the control of the washing procedures. The control panel seat 2 is mounted on the top of the housing 1, and the pedestal 3 is mounted at the bottom of the housing 1, and the inner tub 5 is mounted inside the outer tub 4, there is a coaxial hole at the center of the bottom of the outer tub 4 and the inner tub 5 for the pulsator shaft going through, the clutch device is arranged in the outer tube 4 and the inner tub 5, the inner tub 5 takes the buoyancy work mode, the outer tub 4 is arranged in the housing 1 by damping suspender 14, the motor 6 is a direct driving motor. As FIGS. 1, 2, 3 shown, the motor 6 is installed on the bottom of the outer tub 4 through the bearing block 11. The motor 6 and the bearing block 11 are superimposed on the outer tub 4 in turns, and fixed on the bottom of the outer tub 4 respectively. Or the motor 6 and/or the bearing block 11 is fixed on the bottom of the outer tub 4 by the fixing device arranged on the bottom of the outer tub rather than the fixing connection structure between the motor 6 and/or the bearing block 11 and the outer tub 4. The motor shaft 601 of the motor and the pulsator shaft 8 are connected together movably in the bearing block 11.

As FIGS. 1, 6, 7, 8, 9 shown, the axle centre of the bearing block 11 of the invention is provided with the shaft hole 1110 of the bearing block. After the installation, the shaft hole 1110 of the bearing block has the same axle with the outer tub 4 and the inner tub 5. The positioning structure is provided on the bearing block 11 between the outer tub 4 and the motor 6, and the positioning structure is mounted at the installing surface 1102 of the bearing block 11 contacting with the motor 6 for supporting the motor 6 and preventing the radial movement of the motor. The specific way taken by the positioning structure is the positioning plate 1103. There are at least three positioning plates 1103 on the installing surface 1102 of the bearing block 11, and the positioning plate 1103 is perpendicular to the installing surface 1102 and arranged radially round the shaft hole 1110 of the bearing block 11 as the virtual center. There are also 4-6 positioning plates 1103. The outer contact surface of the positioning plate 1103 contacting the motor is provided with the positioning table 1104 protruding upwards from the contact surface. The vertical distance between the inner edge of the positioning table 1104 and the axis of the shaft hole 1110 is equal to or slightly larger than the diameter of the motor. Thus, at least part of the bottom surface of the motor 6 contact with the positioning plate 1103 when the motor shaft of the motor 6 inserts the shaft hole 1110 of the bearing block 11. The positioning table is located on the outside of the motor; the positioning table 1104 on the positioning plate limits the movement of the motor 6 in various plane directions. The bearing block 11 can be directly fixed on the bottom of the outer tub 4 through a fixing hole 1107. The motor 6 can also be directly fixed on the bottom of the outer tub 4, or connected with the outer tub 4 through the fixing device described embodiments of the following.

Figure 7:
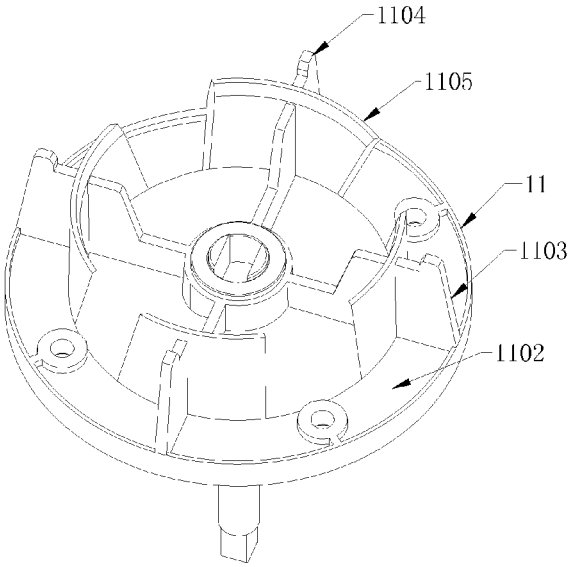
FIG. 7: the schematic illustration of the arc segment structure of the positioning ring in the bearing block in the present invention
Figure 8:
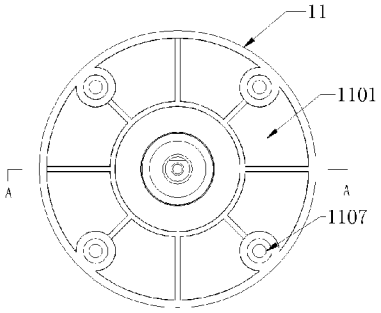
FIG. 8: the schematic illustration of bearing surface of the bearing block in the present invention
Figure 9:
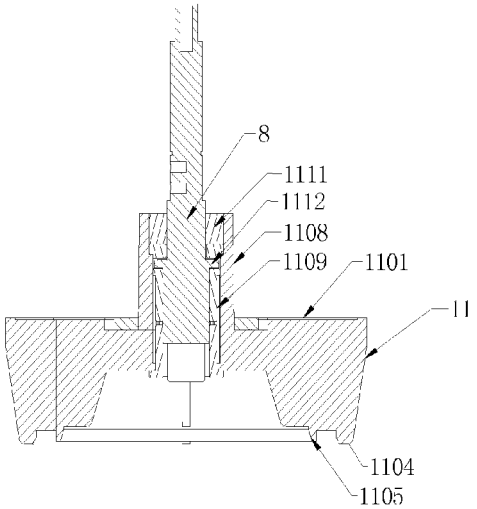
FIG. 9: A-A section view shown in FIG. 9

As FIGS. 1, 4, 6, 7, 8, 9 shown, alternatively, another embodiment of the positioning structure of the bearing block is: the 1105 is mounted at the installing surface 1102 of the bearing block 11, and the positioning ring 1105 is a circular tube concentric with the bearing block 11. The inner diameter of the positioning ring is larger than the one of the shaft hole 1110 of the bearing block 11 and smaller than the one of the motor 6. The motor 6 is provided with a positioning groove 602 matching with the positioning ring 1105. The depth of the positioning groove 602 concaved inside the motor corresponds to the height of the positioning ring. When installing, the motor shaft 601 is inserted into the shaft hole 1110 of the bearing block 11, and the positioning groove 602 on the motor is buckled on the positioning ring 1105 of the bearing block 11 to realize the motor clamping and the translation limitation. As FIG. 7 shown, the positioning ring 1105 is also an incomplete circle, and composed of the discontinuous arc segment. To strengthen the firm of the arc segment, the reinforce rib 1106 can be installed on both sides of the arc segment and the arc section is perpendicular to the installing surface. The motor relates to the scheme is cylindrical; the motor shaft reaches out of the motor.

The positioning ring can also be set on the motor, and the installing surface of the bearing block is provided with the concave positioning groove.

As FIGS. 1, 4, 6, 7, 8, 9 shown, on the basis of the above embodiment, the positioning structure in the embodiment includes a positioning plate 1103 and a positioning ring 1105. Both of the positioning plate 1103 and the positioning ring 1105 are arranged in the installing surface 1102 of the bearing block, and the positioning ring 1105 and the positioning plate 1103 intersect each other. The intersection is a stable cross. This structure makes both the positioning plate and the positioning ring support mutually, so that the whole structure of the bearing block is more compact. The height of the positioning ring 1105 is larger than the height of the positioning plate, and the height difference between the positioning ring 1105 and the height of the positioning plate is corresponding with the depth of the positioning concave ring 602 of the motor 6. When the motor shaft 601 inserts the shaft hole 1110 of the bearing block 11, the outside of the motor is blocked by the positioning table 1104 to not move, and the positioning ring 1105 on the installing surface is inserted the positioning concave ring 602 of the motor 6. In order to improve the strength of the positioning ring and the bearing block, the reinforce rib 1106 is arranged in the positioning ring perpendicular to the axis. The whole positioning structure is more stable in this embodiment.

As FIGS. 1, 6, 7, 8, 9 shown, the fixed surface 1101 of the bearing block 11 contacting with the outer tub 4 is provided with a protective sleeve 1108 which is convex to outside and hollow. The protective sleeve 1108 is an integrated with the bearing block 11. The top of the protective sleeve 1108 is an opening, and the bottom of the protective sleeve 1108 is connected with the shaft hole of the bearing block 11. A shaft sleeve 1109 is arranged in the protective sleeve 1108 and the shaft hole 1110 of the bearing block 11. An end of the pulsator shaft 8 is inserted into the bearing block through the opening on the top of the protective sleeve 1108. The upper end of the protective sleeve 1108 connecting with the pulsator shaft 8 is provided with a skeleton oil seal 1111. The shaft sleeve 1109 and the pulsator shaft 8 are in interference fit. The pulsator shaft 8 is provided with a shield ring 1112 locating between the skeleton oil seal 1111 and the shaft sleeve 1109, and being concave radially. The shield ring 1112 is supported in the top of the shaft sleeve to prevent the pulsator shaft out of the bearing block, and reduce the radial friction effect of the pulsator shaft. The skeleton oil seal has the role of lubricating the pulsator shaft and sealing the protective sleeve. The height of the protective sleeve 1108 is larger than the thickness of the bottom of the outer tub 4. After the bearing block is fixed on the outer tub, the protective sleeve inserts into the outer tub through the shaft hole at the bottom of the outer tub. The protective sleeve is fixed with the shaft hole of the outer tub to form a sealing state. The pulsator shaft connecting to the motor shaft by the bearing block reduces the corresponding parts on the outer tub. When problems occurred, it only need remove the bearing block to realize the repair, and reduced the workload of repair greatly.

Figure 4:
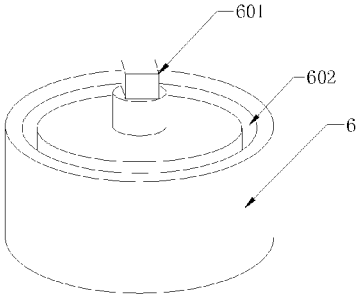
FIG. 4: the schematic illustration of the structure of the motor in the present invention
Figure 5:
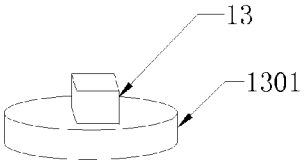
FIG. 5: the schematic illustration of the structure of the insulation unit in the present invention
Figure 6:
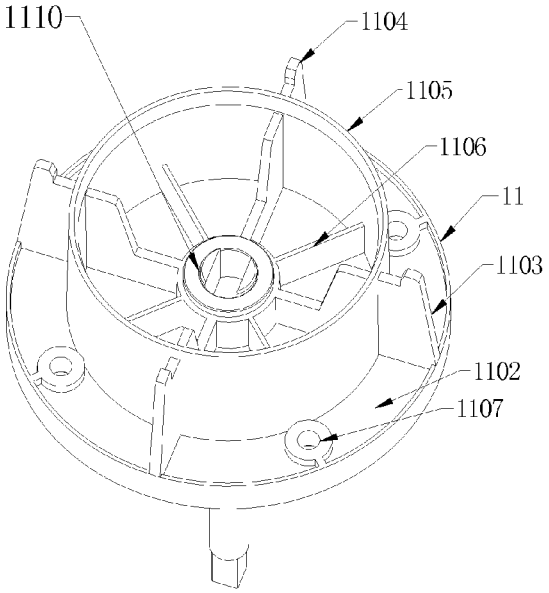
FIG. 6: the schematic illustration of the three-dimensional structure of the bearing block in the present invention

As shown in FIG. 1, the motor shaft 601 of the motor 6 and the pulsator shaft 8 are connected directly, the connection of the both is the movable clamping structure, and the motor shaft 601 can drive the pulsator shaft 8 to rotate together. As shown in FIG. 5, in order to prevent the water from leaking into the protective sleeve 1108 and the shaft hole 1110 of the bearing block 11 in use, and prevent the motor 6 from leaking electric current and transmit electricity to the outer tub 4 and the inner tub 5 through the motor shaft and the pulsator shaft 8, in the embodiment, there is an insulation unit 13 between the motor shaft 601 and the pulsator shaft 8, of which the shape is like a bottle cap. As shown in FIG. 4, in the embodiment, the top of the motor shaft is designed to the polyhedral shape, including the triangle, the quadrangle, the pentagon or the hexagon and so on, which is the structure increasing friction in the radial rotation after clamping. The corresponding shape of the insulation unit and the connected end of the pulsator shaft are the same, but the structure of the connected end of the pulsator shaft is the internal groove. In the process of installation, the insulation unit 13 can be placed inside the internal groove of the pulsator shaft or sheathed on the top of the motor shaft, then the three components are inserted together. The insulation unit is made of the insulating material, of which the thickness is between 2~2.5 mm, preferably 2.2 mm.

As shown in FIG. 5, in order to avoid the shaft sleeve 1109 become the leakage conduction path, preferably, a radially extending sheath 1301 is made at the end of the shaft sleeve 1109 according to the size of the insulation unit 13. So, after the insulation unit is installed, not only the contact between the motor shaft 601 and the pulsator shaft 8 can be isolated, but also the contact between the two components and the shaft sleeve 1109 can be isolated. Thus, the safety coefficient of the washing machine is improved, and the sheath 1301 can prevent the water flowing in the interior of the motor and keep water flowing along the pulsator shaft off the outside the interface of the motor shaft and the motor, when the water leaking due to the poor sealing of the outer tub.

As FIGS. 1, 2, 3 shown, the fixed device fixing the motor 6 and/or the bearing block 11 to the bottom of the outer tub is a fixing belt 7 with the shape of "U". The fixing belt 7 comprises two sides 701 and a pressing edge 702 for connecting the two sides 701 and compacting the motor. The fixing belt 7 is made of the materials with a certain hardness, such as iron, steel, hard plastic. The motor 6 is a direct driving motor. The two sides 701 are respectively fixed on the bottom of the outer tub 4 through the ends. There is a fixing hole 703 in the pressing edge 702. A bearing bulge is provided on the other side of the motor relative to the motor shaft to fix the rear end of the motor shaft. The position of the fixing hole is corresponding with the position of the bearing bulge. The fixing belt 7 fixes the motor 6 and the bearing block 11 to the bottom of the outer tub by pressing. In order to improve the contact effect of the fixing belt 7 and the motor 6, the pressing edge 702 is provided with a fixing hole 703; the fixing hole 703 is corresponding with the position of the bearing bulge. A shock pad for sealing and shock absorption is arranged between the bearing bulge and the fixing hole. The shock pad also is good for the balance work of the motor. When fixing it, the ends of the two sides are fixed on the bottom of the tub through bolts. The fixing belt can use the metal with certain strength to realize the fixed effect.

Figure 10:
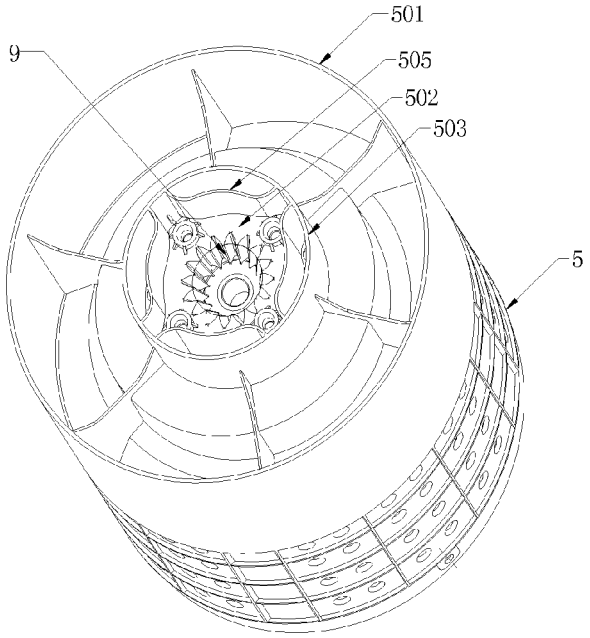
FIG. 10: the schematic illustration of the arc segment structure of the buoyancy chamber in the bottom of the inner tub in the present invention
Figure 11:
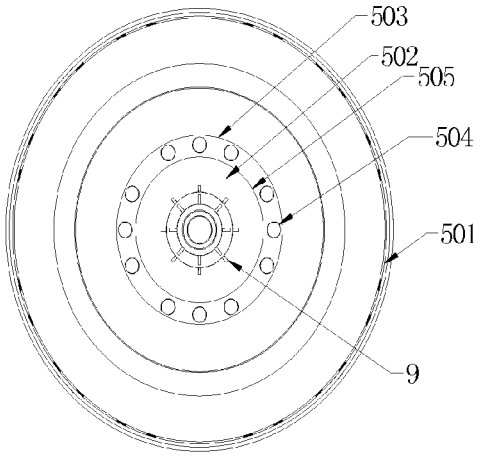
FIG. 11: the upward view of the bottom of the inner tub in the present invention

As FIGS. 1, 10, 11 shown, the clutch device of the present invention includes the concave gear 9 installing in the shaft hole at the bottom of the inner tub, and the convex gears 10 mounted on the pulsator shaft between the outer tub and the inner tub. A concave cylinder with a downward opening is provided at the bottom of the inner tub, to form a buoyancy chamber 501. when the washing machine is in the dehydration or not working, the concave gear and the convex gear are meshing. When the washing machine is filled with water, the inner buoyancy chamber forms a sealing cavity under the pressure of the air, the inner tub is driven to rise along the pulsator shaft, at this moment the concave gear and convex gear are driven separately, then the washing machine starts washing.

An inner buoyancy chamber 502 is arranged in the buoyancy chamber 501. The inner buoyancy chamber 502 is constituted by the insulation rib 505, and the insulation rib is the structure of a tube and arranged around the concave gear 9 and has the same axle with the concave gear 9. The periphery of the insulation rib 505 is provided with an insulation ring 503. As FIG. 11 shown, the insulation ring is the structure of a tube, and forms an independent closed space with the insulation rib. Water holes through the bottom of the inner tub are arranged in the independent closed space between the insulation rib 505 and the insulation ring 503. The water holes are used for the exchange and circulation of the washing water between the inner tub and the outer tub. The insulation rib forms a closed chamber around the concave gear 9. The closed chamber forms the inner buoyancy chamber 502 when the inner tub 5 connects with the pulsator shaft 8, and the buoyancy chamber 501 is formed between the insulation ring 503 and the concave cylinder at the bottom of the inner tub. The buoyancy chamber 501 and the inner buoyancy chamber 502 are pushed by the washing water to generate buoyancy to drive the inner tub 5 up.

In the embodiment, the insulation rib 505 integrates with the concave gear 9, namely, the hollow coaxial and vertical pipe is arranged around the concave gear. This structure can form an inner buoyancy chamber at the bottom of the inner tub at the time of installing the concave gear. The insulation rib 505 integrates with the bottom of the inner tub. This structure can be made by the integrated processing molding with the inner tub, and the process is simple.

Figure 13:
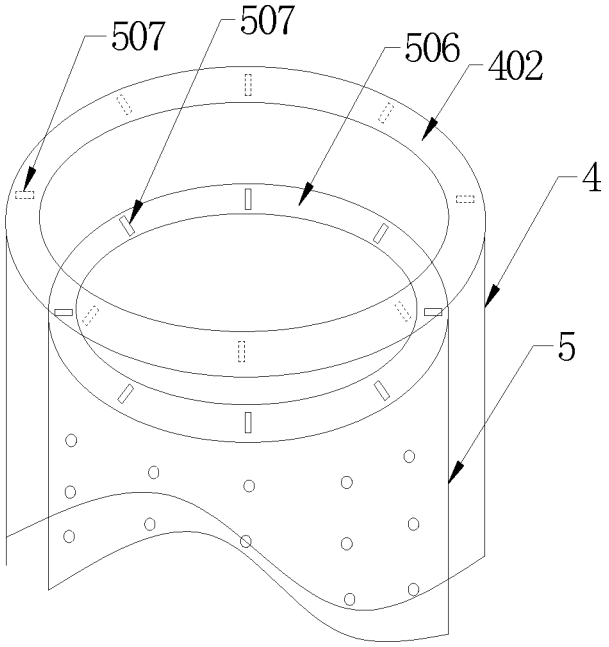
FIG. 13: the schematic illustration of the structure of stopping the inner tub to float in the present invention

As FIG. 13 shown, in order to avoid that the inner tub 5 after rising rotates synchronously with the pulsator, to reduce the friction with the inner wall of the inner tub of clothes and affect the washing effect, in the embodiment, the balance ring 506 on the top of the tub is provided with a bulge 507 protruding from the balance ring. The bulge can be bar or block, and uniformly distributed on the surface of the balance ring. A cover 402 of the outer tub is arranged on the top of the outer tub 4, and the cover of the outer tub is ring and extends to the center of the ring. A bulge 507 is arranged on the surface of the cover 402 of the outer tub confronting the balance ring 506. When the washing machine is working, the buoyancy chamber 501 and the inner buoyancy chamber 502 at the bottom of the inner tub utilize the buoyancy of the water to make the inner tub 5 rise, and the concave gear 9 at the bottom of the inner tub and the convex gear on the pulsator shaft are separated. When the inner tub 5 floats up to a certain height, the balance ring of the inner tub contacts the cover 402 of the outer tub, and the bulge 507 on the balance ring 506 and on the cover 402 of the outer tub obstruct each other to stop the rotation of the inner tub 5. At this moment, the rotation of the pulsator shaft 8 drives the pulsator in the inner tub to rotate. In the embodiment, the structure is simple, and the setting is convenient.

As FIGS. 1, 6, 7, 8, 9, 10, 11 shown, on the basis of the above described embodiments, in order to prevent the washing water from going into the skeleton oil seal 1111 via the top of the protective sleeve, the protective sleeve has enough height, at least the top of the protective sleeve is in the sealing cavity of the inner buoyancy chamber 502 after installed, to prevent the washing water from contacting with the pulsator shaft between the convex gear 10 and the concave gear 9 and the top of the protective sleeve. Thus, it can be avoided that the impurities contained in the washing water adhere to the pulsator shaft and the protective sleeve. It will ensure the normal lifting of the inner tub and prolong the service life of the skeleton oil seal. In the embodiment, the height of the insulation rib is adjusted according to the position of assembly of the concave gear 9 and the convex gear 10 to ensure that the sealing cavity formed by the insulation rib 505 includes the top of the protective sleeve 1108, when the inner tub floats up to the washing position. So the end of the insulation rib needs to be higher than the inner cylinder chamber 501 of the inner tub to increase the air in the inner cylinder chamber.

In process of working, the washing machine is being filled with water, the two sealing cavities of the buoyancy chamber 501 and the inner buoyancy chamber 502 push the inner tub 5 to float up. The water holes are for the circulation of washing water between the inner tub and the outer tub, the resistance of the inner tub is reduced. At the moment, the top of the protective sleeve 1108 is in the sealing cavity of the inner buoyancy chamber 502 and reach out of washing water, thus prevents the washing water into the protective sleeve from the top of the protective sleeve, and achieves the waterproof effect.

Figure 12:
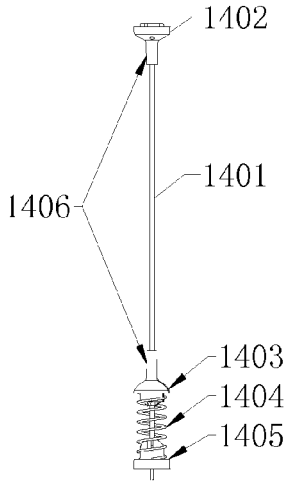
FIG. 12: the schematic illustration of the structure of the damping suspender in the present invention

As FIG. 12 shown, the washing machine in the embodiment adopts the damping mode of the damping suspender. The damping suspender 14 includes the suspender 1401, the upper spherical seat 1402 on the top of the suspender, the lower spherical seat which is set in series on the bottom of the suspender, the spring 1404 and the spring seat 1405. As FIG. 1 shown, the suspension seat corresponding with the concave and convex of the upper spherical seat 1402 is arranged in the top of the housing. The damping seat 401 corresponding with the concave and convex of the lower spherical seat is distributed around the side of the outer tub 5. The suspension seat and the damping seat are provided with the fractures of which the diameter is larger than the one of the suspender 1401. Both the contact surface between the damping seat and the upper spherical seat and the contact surface between the damping seat and the lower spherical seat are the cambered surfaces contact of the concave-convex matching. In the installation, the suspender 1401 is cut-in the fracture, the upper spherical seat and the lower spherical seat are securely against the suspension seat and the damping seat respectively under the action of gravity of the inner tub and the outer tub, then the upper spherical seat and the lower spherical seat seal up the fracture, thereby prevent the suspender from taking off. In order to avoid the suspender taking off from the fracture when the washing machine is moved, a conical convex tube 1406 is arranged in the shaft hole where the lower spherical seat and the damping seat contact each other. The diameter of the conical tube is larger than the one of the fracture. As long as the moving distance of the lower spherical seat does not exceed the length of the conical tube, the suspender will not emerge from fracture. In the embodiment, the four corners of the housing of the washing machine are provided with the damping suspender respectively, and the outer tub is in a relatively free equilibrium position in the housing because of the pulling force of the damping suspender, and the collision between the outer tub and the housing is prevented.

The work process of washing machine of this scheme is as follows: put the washing clothes into the washing machine and the washing amount is within 1 kg, the washing machine starts the washing procedures under the automatic washing program control, the water is inflowing into the washing machine, in the injection process, the buoyancy chamber and the inner buoyancy chamber of the bottom of the inner tub promote the inner tub along the pulsator shaft to rise in the action of the buoyancy of the water, the concave gear at the bottom of the inner tub and the convex gear on the pulsator shaft are detached, when the inner tub rises to a certain height, the balance ring on the top of the inner tub and the cover of the outer tub at the top of the outer tub contact each other, the convexes of the both contact with each other, then the washing starts, in the washing process, the motor shaft of the motor drives the pulsator shaft to rotate in the bearing block directly, and drives the pulsator to wash the clothes, in the washing process, the inner tub is in a relatively quiescent state because of the stopping of the bulge on the balance ring and the cover of the outer tub, the protective sleeve of the bearing block extends into the inner buoyancy chamber, avoid the washing water into the protective sleeve and prevent the washing water stains dipping to the pulsator shaft between the concave gear and convex gear. After the washing and rinsing, the water is drained off, the inner tub is falling along the pulsator shaft after losing the buoyancy, finally, the concave gear on the inner tub and the convex gear on the pulsator shaft are meshing, then the dehydration procedure starts, the convex gear on the pulsator shaft drives the inner tub to rotate through the concave gear to realize the clothes dehydration.

The invention claimed is:

1. A pulsator-type automatic washing machine, comprising a housing, a control panel seat, a pedestal, an outer tub, an inner tub and a motor, the control panel seat being mounted on the top of the housing, and the pedestal being mounted at the bottom of the housing, and the outer tub and the inner tub being mounted inside the housing, wherein, the motor is a direct driving motor, and the motor and a bearing block are mounted at the bottom of the outer tub, and the motor is fixed on the outer tub by a fixing device, a motor shaft is coupled with a pulsator shaft inside the bearing block, and a buoyancy clutch device, the buoyancy clutch device comprising:

a buoyancy chamber at a bottom of the inner tub, a concave gear arranged around a shaft hole at the bottom of the inner tub; and a convex gear arranged on the pulsator shaft between the outer tub and the inner tube;

a balance ring arranged on a top of the inner tub;

a cover of the outer tub arranged on the outer tub;

a blocking structure arranged on the top of the inner tub and the top of the outer tub, the blocking structure including a first bulge arranged on a surface of the balance ring and a second bulge arranged on a surface of the cover of the outer tub facing to the balance ring, the bulges being bar-shaped or block-shaped, and uniformly distributed on the surface of the balance ring and on the surface of the cover;

the first bulge on the balance ring and the second bulge on the cover of the outer tub being configured to obstruct each other for preventing the inner tub from rotating synchronously with the pulsator after the inner tub floats up.

2. The pulsator-type automatic washing machine according to claim 1, wherein, a positioning structure matching with the motor is installed on the bearing block to prevent the radial movement of the motor, and at least the positioning structure holds the motor partially.

3. The pulsator-type automatic washing machine according to claim 2, wherein, a positioning plate and/or a positioning ring is mounted at an installing surface of the bearing block mating with the motor, the positioning plate is perpendicular to the installing surface and arranged around a shaft hole of the bearing block as the virtual center radially and symmetrically, a contact surface of the positioning plate contacting with the motor is partially provided with a positioning table protruding from the contact surface, the vertical distance between an inner edge of the positioning table and the axis of the shaft hole is equal to or slightly larger than the diameter of the motor, the positioning ring is a circular tube or an arc segment concentric with the shaft hole of the bearing block, of which diameter is larger than the one of the shaft hole, and a surface of the motor contacting with the bearing block is provided with a positioning groove matching with the positioning ring.

4. The pulsator-type automatic washing machine according to claim 3, wherein, the positioning ring intersects the positioning plate, and the positioning ring is higher than the positioning plate at the intersection.

5. The pulsator-type automatic washing machine according to claim 1, wherein, a fixed surface of the bearing block contacting with the bottom of the outer tub is provided with a protective sleeve being upwards convex along the circumference of a shaft hole of the bearing block, and the motor shaft and the pulsator shaft are coaxially connected through the protective sleeve.

6. The pulsator-type automatic washing machine according to claim 5, wherein, a skeleton oil seal is arranged in the upper end of the protective sleeve, a shaft sleeve is provided on the lower end of the protective sleeve and inside the shaft hole of the bearing block, and the pulsator shaft is provided with a shield ring located between the skeleton oil seal and the shaft sleeve.

7. The pulsator-type automatic washing machine according to claim 5, wherein, a height of the protective sleeve is larger than a thickness of the bottom of the outer tub.

8. The pulsator-type automatic washing machine according to claim 1, wherein, an insulation unit is provided between the motor shaft and the pulsator shaft to prevent from directly contacting the motor shaft with the pulsator shaft, and the structure of the insulation unit is configured to adapt the structure of the contact surface between the motor shaft and the pulsator shaft.

9. The pulsator-type automatic washing machine according to claim 8, wherein, the insulation unit comprises:

a sheath of which a diameter is larger than a diameter of a shaft hole of the bearing block; and the sheath is a cylindrical plane and perpendicular to the motor shaft.

10. The pulsator-type automatic washing machine according to claim 1, wherein, the fixing device is a fixing belt with the shape of a "U", the fixing belt comprises two sides and a pressing edge for connecting the two sides, the two sides are respectively fixed on the bottom of the outer tub through the ends, and the fixing belt presses and fixes the motor and the bearing block on the bottom of the outer tub.

11. The pulsator-type automatic washing machine according to claim 10, wherein, a bearing bulge is provided on another side of the motor being relative to the motor shaft, a fixing hole is arranged in the middle of the pressing edge, the fixing hole corresponds to the bearing bulge, and a shock pad is provided between the fixing hole and the bearing bulge.

12. The pulsator-type automatic washing machine according to claim 1, wherein, an inner buoyancy chamber is provided around the shaft hole of the pulsator shaft in the buoyancy chamber, the inner buoyancy chamber is circumferentially constituted by an insulation rib integrating with the bottom of the inner tub, and the inner buoyancy chamber is configured to form a sealing cavity after the washing machine is filled with water.

13. The pulsator-type automatic washing machine according to claim 12, wherein, the periphery of the insulation rib is provided with a insulation ring integrating with the bottom of the inner tub, water holes are arranged on the inner tub between the insulation rib and the insulation ring.

14. The pulsator-type automatic washing machine according to claim 1, wherein, the top of the motor shaft connects with the pulsator shaft flexibly.

15. The pulsator-type automatic washing machine according to claim 13, wherein, an insulation unit with a shape of a bottle cap is arranged between the motor shaft and the pulsator shaft, and the center of the bottle cap is provided with a bulge that is configured to adapt to the structure of the contact surface between the motor shaft and the pulsator shaft.

16. The pulsator-type automatic washing machine according to claim 2, wherein, the positioning structure is at least three positioning plates and/or at least one positioning ring.

17. The pulsator-type automatic washing machine according to claim 13, wherein, the top of the insulation ring protrudes from the top of the buoyancy chamber, the height of the protective sleeve on the bearing block is larger than the thickness of the bottom of the outer tub, and the protective sleeve extends partially into the inner buoyancy chamber.

18. The pulsator-type automatic washing machine according to claim 16, wherein, the motor shaft connects with the pulsator shaft by gears, or the top of the motor shaft is a polygonal prism, and an inner groove is arranged on the contact end of the pulsator shaft for matching with the motor shaft.

19. The pulsator type automatic washing machine according to claim 1, comprising a washing capacity of less than 1 kg.

* * * * *